US012539903B2

(12) United States Patent
Xu et al.

(10) Patent No.: US 12,539,903 B2
(45) Date of Patent: Feb. 3, 2026

(54) SAFETY CHECK METHOD AND DEVICE FOR COUPLING OF MULTIPLE TRAIN UNITS IN RAIL TRANSIT, AND MEDIUM

(71) Applicant: CASCO SIGNAL LTD., Shanghai (CN)

(72) Inventors: Ye Xu, Shanghai (CN); Haigang Cui, Shanghai (CN); Zhichen Hua, Shanghai (CN); Haiping Chu, Shanghai (CN); Chen Wang, Shanghai (CN)

(73) Assignee: CASCO SIGNAL LTD., Shanghai (CN)

( * ) Notice: Subject to any disclaimer, the term of this patent is extended or adjusted under 35 U.S.C. 154(b) by 17 days.

(21) Appl. No.: 18/719,136

(22) PCT Filed: Nov. 30, 2022

(86) PCT No.: PCT/CN2022/135640
§ 371 (c)(1),
(2) Date: Jun. 12, 2024

(87) PCT Pub. No.: WO2024/001040
PCT Pub. Date: Jan. 4, 2024

(65) Prior Publication Data

US 2025/0050923 A1 Feb. 13, 2025

(30) Foreign Application Priority Data

Jun. 30, 2022 (CN) ..... 202210770671.0

(51) Int. Cl.
*B61L 27/04* (2006.01)
*B61L 27/20* (2022.01)

(52) U.S. Cl.
CPC ..... *B61L 27/04* (2013.01); *B61L 27/20* (2022.01)

(58) Field of Classification Search
CPC ..... B61L 27/04; B61L 27/20; B61L 25/028; B61L 15/0081; B61L 23/34; B61L 27/40;
(Continued)

(56) References Cited

U.S. PATENT DOCUMENTS

2023/0117087 A1* 4/2023 Sun ..... B61L 15/0081 701/20

FOREIGN PATENT DOCUMENTS

AT E359947 T1 5/2007
CN 108163012 A 6/2018
(Continued)

OTHER PUBLICATIONS

International Search Report (with English translation) and Written Opinion issued in PCT/CN2022/135640, dated Mar. 24, 2023, 10 pages provided.

*Primary Examiner* — Long T Tran
*Assistant Examiner* — Charles J Brauch
(74) *Attorney, Agent, or Firm* — HSML P.C.

(57) ABSTRACT

The present invention relates to a safety check method and device for coupling of multiple train units in rail transit, and medium, the method including: determining train formation information to obtain the length, weight and traction braking characteristics of the whole train, so as to automatically protect the running of the train on a route and realize automatic driving. Compared with the prior art, the present invention can detect the coupling states of more than 2 marshalled trains.

15 Claims, 3 Drawing Sheets

(58) Field of Classification Search
CPC ..... B61L 27/00; B61L 15/00; B61L 25/00;
B61L 25/04; B61L 27/57
See application file for complete search history.

(56) References Cited

FOREIGN PATENT DOCUMENTS

| | | | |
|---|---|---|---|
| CN | 111267915 | A | 6/2020 |
| CN | 111891138 | A | 11/2020 |
| CN | 112319558 | A | 2/2021 |
| CN | 115303331 | A | 11/2022 |

* cited by examiner

SAFETY CHECK METHOD AND DEVICE FOR COUPLING OF MULTIPLE TRAIN UNITS IN RAIL TRANSIT, AND MEDIUM

FIELD OF TECHNOLOGY

The present invention relates to a rail transit signal system, in particular to a Safety check method and device for coupling of multiple train units in rail transit, and medium.

BACKGROUND

A passenger flow of urban rail transit is usually unbalanced during a day, especially for peripheral lines connecting a suburban area of a city and an urban area of the city, which have obvious tidal phenomena. In operation organization, the problem is usually solved by using a different operation diagram when morning and evening peak and daytime passenger flows are relatively underestimated. For longer lines that run between the suburban and the city center, more capacity would be put into the urban area by means of part and full routes. It can be imagined that in this way, a train running interval in the suburban during the daytime would be very long.

One strategy to solve the above problem is to realize a mixed operation organization mode of multi-marshalled trains through a function of online coupling and uncoupling of signals and trains. For example, Shanghai Rail Transit line 16 can form a six-marshalled train from coupling two three-marshalled trains on the mainline. For example, the six-marshalled train can be put into operation during a peak period, and it can be uncoupled into three-marshalling operation during flat peak, so that a daytime train operation interval can be shortened as much as possible without wasting too much capacity, and passenger satisfaction can be improved.

When the train passes through a long large tunnel interval, if an existing "small marshalling, high density" mode is adopted, a single-marshalled train operating inside the tunnel would bear a greater air pressure due to piston wind effect between the tunnel and the train. Meanwhile, the above operation organization manner is not conducive to design of emergency passenger evacuation scenarios such as fire or water disasters. Through implementation of an online flexible train marshalling technology, small marshalled trains can be coupled to a large marshalled train before the trains enter the tunnel, such as a "3+3+3" multi-marshalling manner, and after the large marshalled train passes through the tunnel, it can be uncoupled into the small marshalled trains according to an operation requirement.

After searching, disclosed in a Chinese patent application with a publication number CN111267915A is a safety detection method for a train marshalling state of urban rail transit, and a train coupling detection method thereof is only applicable to a safety detection of two train coupling. When a size of multi-marshalled trains is larger than two train coupling, it can not be realized by the original detection method of the two train coupling state. Therefore, how to realize the safety detection of more than two train coupling has become a technical problem to be solved.

SUMMARY

The purpose of the present invention is to provide a Safety check method and device for coupling of multiple train units in rail transit, and medium in order to overcome the defects existing in the prior art.

The purpose of the present invention can be realized by the following technical solutions:

According to a first aspect of the present invention, provided is a safety check method and device for coupling of multiple train units in rail transit, comprising: determining train formation information to obtain the length, weight and traction braking characteristics of the whole train, so as to automatically protect the running of the train on a route and realize automatic driving.

As a preferred technical solution, all the train formation combinations and formation ID numbers in the route are pre-defined; when the formation ID number is greater than 2, a trackside zone controller ZC calculates a train formation ID according to a train coupling state detected by each onboard controller CC, and continuously transmits the calculated train formation ID to the CC; and CC controls and safely protects the train according to the obtained train formation.

As a preferred technical solution, all the train marshalling combinations and formation ID numbers are specifically as follows:

- a minimum formation train ID that a single route can run is 1;
- a formation ID of a coupled train consisting of two minimum formation trains is 2;
- a formation ID of a coupled train consisting of three minimum formation trains is 3;
- . . . ;
- a formation ID of a coupled train consisting of X minimum formation trains is x, wherein X is the number of minimum formation trains.

As a preferred technical solution, the train coupling state detected by the CC is specifically as follows:

(1) input information "coupler coupling" and "coupler uncoupling" of couplers at both ends of each train acquired by the CC of the train; and (2) the train coupling state of each end of the train transmitted by CC to the trackside controller ZC.

As a preferred technical solution, the zone controller ZC determines whether each end of the train is safely coupled according to a coupler coupling state transmitted by each CC, which is specifically as follows:

safe coupling state: ACS=1, ANCS=0;

not safe coupling state: ACS=0, ANCS=1; and unknown coupling state: ACS=1, ANCS=1 or ACS=0, ANCS=0, wherein ACS indicates that the coupler is coupled, and ANCS indicates that the coupler is uncoupled.

As a preferred technical solution, the calculation of the train formation ID by the trackside zone controller ZC comprises:

if two coupling states of one end of the train and one end of an adjacent train are both "not safe coupling state", or if one end of the train is "not safe coupling state" and one end of the adjacent train is "unknown coupling state", the ZC determines that the end of the train is not safely coupled; and if two ends of the train are both not "safely coupled", the ZC determines that the train is a non-coupled train and transmits a train formation ID=1 to the CC.

As a preferred technical solution, the calculation of the train formation ID by the trackside zone controller ZC comprises:

if two coupling states of two adjacent train ends are both "unknown coupling state", or if one is "safe coupling state" and the other one is "not safe coupling state", the ZC transmits a train formation ID=0 to each CC.

As a preferred technical solution, the calculation of the train formation ID by the trackside zone controller ZC comprises:

if two coupling states of two adjacent train ends are both "safe coupling state", or if one is "safe coupling state" and the other one is "unknown coupling state", the ZC checks the safety coupling states of two adjacent train ends on the other side until the train end "not safe coupling state", calculates the train formation ID according to the number of the passed "minimum train formation trains", and send the train formation ID to the CC.

As a preferred technical solution, if the coupling state of the last checked train end during calculation is "unknown coupling state", the train formation ID is determined to be 0.

As a preferred technical solution, the train formation ID is obtained by means of internal calculation and determination of a signal system.

As a preferred technical solution, the method is applicable to various standards of rail transit signal systems.

As a preferred technical solution, the method is applicable to a fixed block system, a quasi-moving block system and a moving block system.

As a preferred technical solution, the method is applicable to a CBTC system, a CTCS system, an ETCS system, a PTC system, an ITCS system, and a TACS system.

As a preferred technical solution, the method supports online coupling and uncoupled of more than 2 marshalled trains.

According to a second aspect of the present invention, provided is an electronic device, comprising a processor and a memory in which a computer program is stored, wherein the processor, when executing the program, implements the above-mentioned methods.

According to a third aspect of the present invention, provided is a computer-readable storage medium in which a computer program is stored, wherein the program, when being executed by a processor, implements the above-mentioned methods.

Compared with the prior art, the present invention has the following advantages:

(1) the present invention can detect the coupling states of more than 2 marshalled trains, so as to automatically protect the running of the train on the route and realize automatic driving;

(2) the number of train coupling marshalling of the present invention can be obtained by means of internal calculation and determination of the signal system, without relying on an additional external input;

(3) the present invention can support online coupling and uncoupled of multi-marshalled (more than 2 marshalled) trains; and (4) the present invention uses the trackside zone controller ZC to calculate the train formation; each train in the multi-marshalled trains only needs to send the coupling state of each end of train, and the system of each train does not need to calculate the train formation through mutual communication and mutual verification; and the trackside zone controller ZC only needs to manage the train formation uniformly, which reduces the complexity of train formation calculation.

DESCRIPTION OF THE EMBODIMENTS

The following is a clear and complete description of the technical solutions in the embodiments of the present invention in combination with accompanying drawings attached to the embodiments of the present invention. Obviously, the embodiments described are a part of the embodiments of the present invention, but not the whole embodiments. Based on the embodiments of the present invention, all other embodiments obtained by a person skilled in the art without creative labor shall fall within the protection scope of the present invention.

Provided in the present invention is a safety check method and device for coupling of multiple train units in rail transit, comprising: determining formation information of the train to obtain the length, weight and traction braking characteristics of the whole train, so as to automatically protect the running of the train on a route and realize automatic driving.

The method of the present invention may be used for a fixed block system, quasi-moving block system, a moving block system, and signal systems with train coupling and uncoupling function under varies standards such as a CBTC system, a CTCS system, an ETCS system, a PTC system, an ITCS system, and a TACS system.

All the train formation combinations and formation ID numbers in the route are pre-defined in the signal system.

a minimum formation train ID that a single route can run is 1;

a formation ID of a coupled train consisting of two minimum marshalled trains is 2;

a formation ID of a coupled train consisting of three minimum marshalled trains is 3;

. . . ;

a formation ID of a coupled train consisting of X minimum marshalled trains is x (wherein X is the number of minimum marshalled trains).

Figure 1:
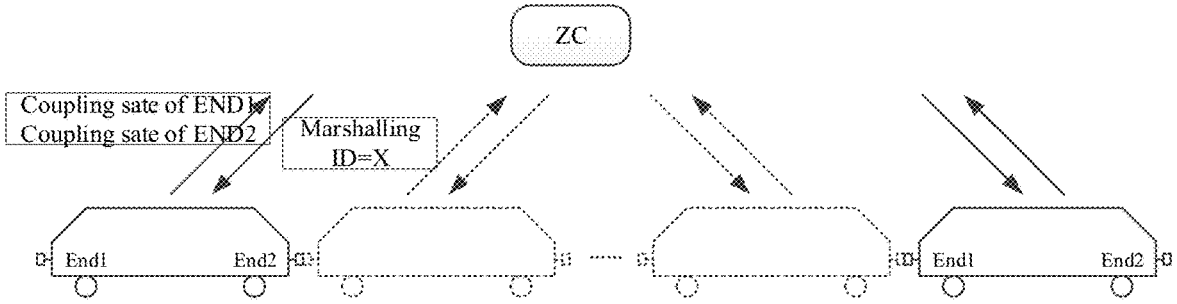
FIG. 1 is a schematic diagram of calculating a train formation ID by a trackside zone controller ZC.

As shown in FIG. 1, when the train formation ID is greater than 2, a trackside zone controller ZC calculates a train formation ID according to a train coupling state calculated by each CC, and continuously transmits the confirmed calculated train formation ID to the CC; and the CC controls and safely protects the train according to the obtained train formation.

A detection method of the CC on the coupling states of both ends of the train is as follows:

(1) the CC of each train collects input information of "coupler coupling" (abbreviated as "ACS") and "coupler uncoupling" (abbreviated as "ANCS") of the couplers at both ends of the train; and (2) the train coupling state of each end of the train transmitted by the controller CC to the trackside controller ZC, that is, the ACS state or the ANCS state;

The zone controller ZC determines whether each end of the train is safely coupled according to a coupler coupling state transmitted by each controller CC:

safe coupling state: ACS=1, ANCS=0;

not safe coupling state: ACS=0, ANCS=1; and unknown coupling state: ACS=1, ANCS=1 or ACS=0, ANCS=0.

Figure 2:
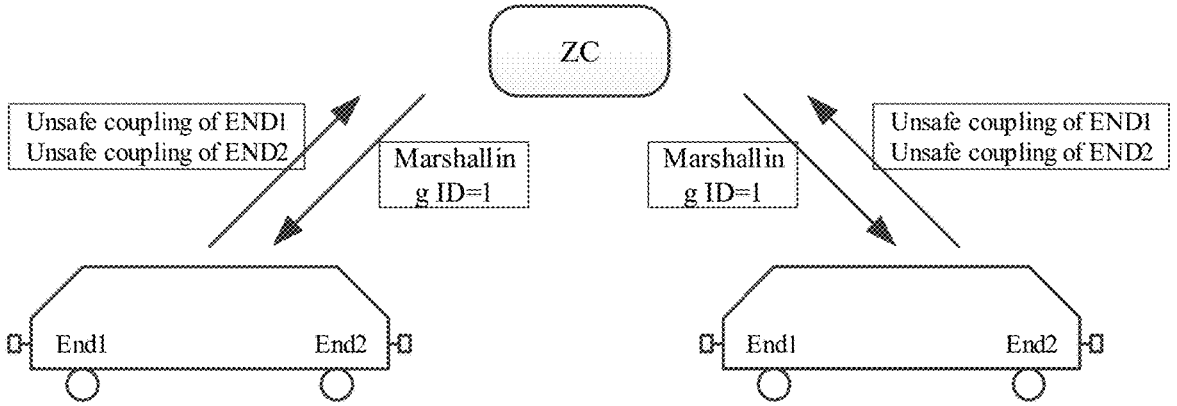
FIG. 2 is a schematic diagram of calculating a train formation ID=1.
Figure 3:
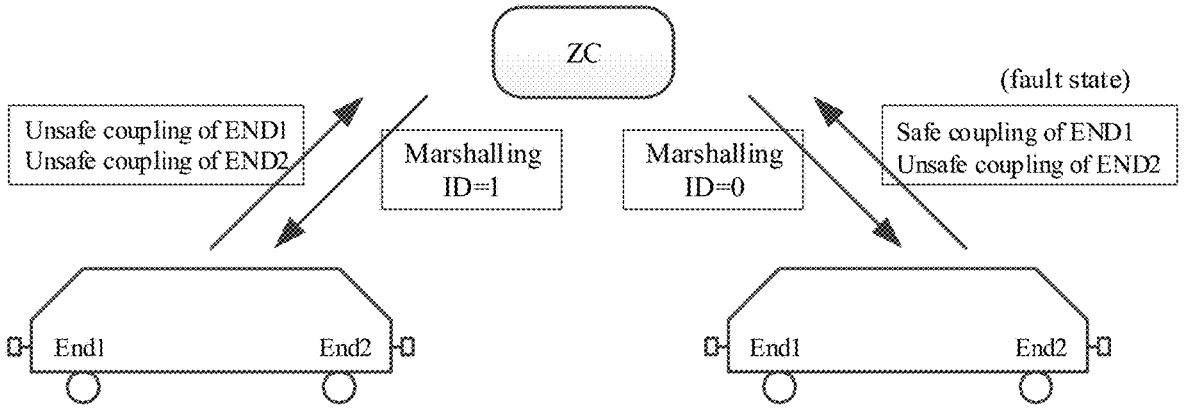
FIG. 3 is another schematic diagram of calculating a train formation ID=1.
Figure 4:
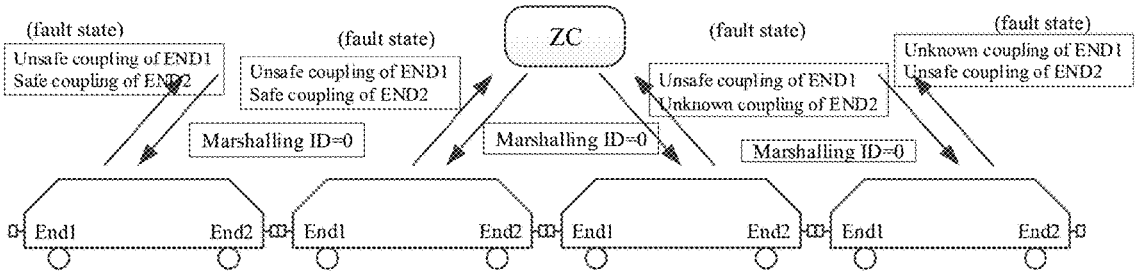
FIG. 4 is a schematic diagram of calculating a train formation ID=0.
Figure 5:
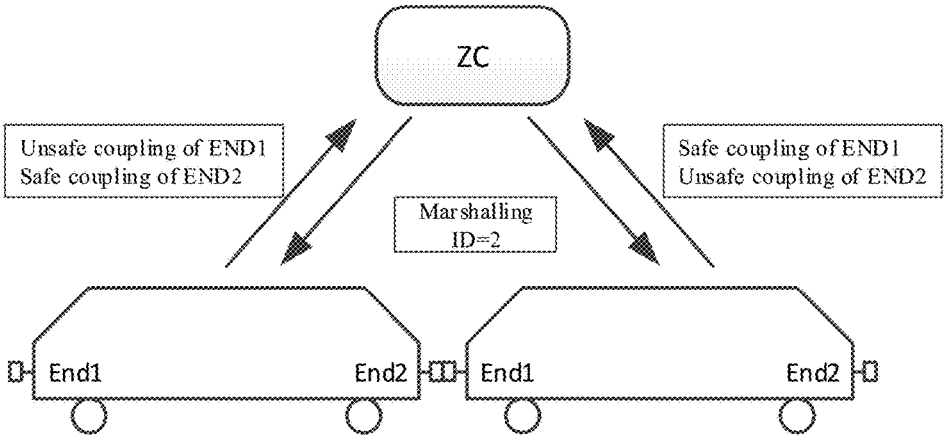
FIG. 5 is a schematic diagram of calculating a train formation ID=2.
Figure 6:
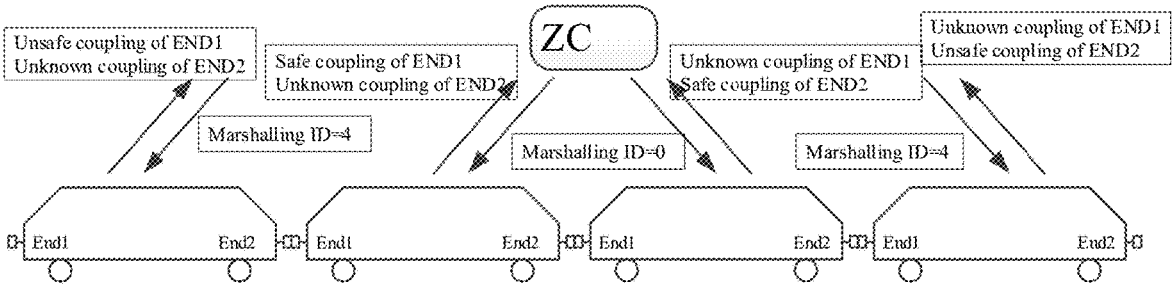
FIG. 6 is a schematic diagram of calculating a train formation ID=4.

The ZC calculates the train formation ID as follows:

(1) if two coupling states of one end of the train and one end of an adjacent train are both "not safe coupling state", or if one end of the train is "not safe coupling state" and one end of the adjacent train is "unknown coupling state", the ZC determines that the end of the train is not safely coupled; and if two ends of the train are both not "safely coupled", the ZC determines that the train is a non-coupled train (minimum marshalled train on a single route) and transmits a train formation ID=1 to the CC, as shown in FIG. 2 and FIG. 3;

(2) if two coupling states of two adjacent train ends are both "unknown coupling state", or if one is "safe coupling state" and the other one is "not safe coupling state", the ZC transmits a train formation ID=0 (unknown) to each CC, as shown in FIG. 4; and (3) if two coupling states of two adjacent train ends are both "safe coupling state", or if one is "safe coupling state" and the other one is "unknown coupling state", the ZC checks the safety coupling states of two adjacent train ends on the other side until the train end "not safe coupling state", calculates the train formation ID according to the number of the passed "minimum train marshalled trains", and send the train formation ID to the CC. If the coupling state of the last checked train end during calculation is "unknown coupling", the train formation ID is determined to be 0 (unknown), as shown in FIG. 5 and FIG. 6.

Specific example is as follows:

There is a minimum marshalled train TU on a route, and possible coupling modes are two formation coupling (that is, TU+TU), and three formation coupling (that is, TU+TU+TU).

Defining the formation ID of a minimum marshalled train=1, the formation ID of two marshalled train=2, formation ID of three marshalled train=3, and the rest unknown formation ID=0.

Figure 7:
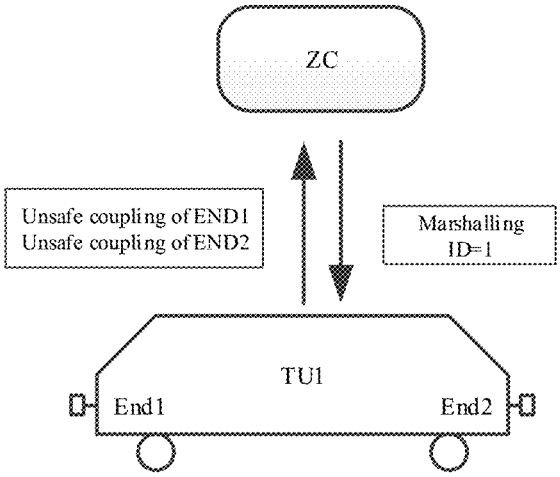
FIG. 7 is a schematic diagram of a train formation ID=1 in a specific embodiment.
Figure 8:
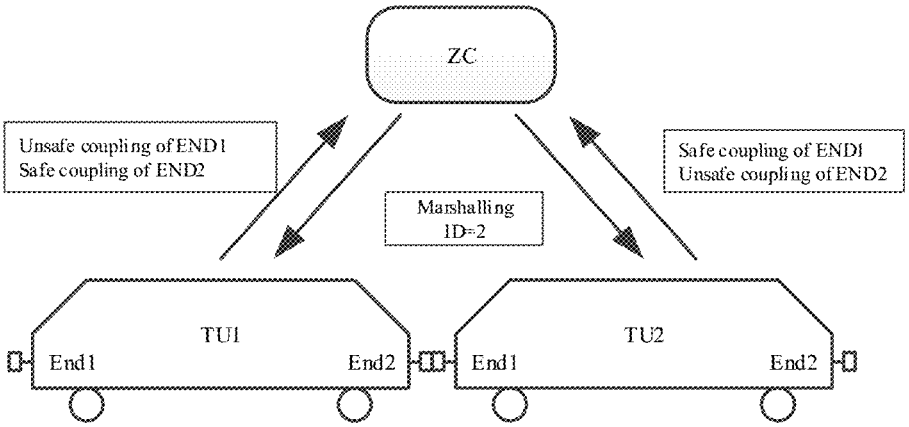
FIG. 8 is a schematic diagram of a train formation ID=2 in a specific embodiment.
Figure 9:
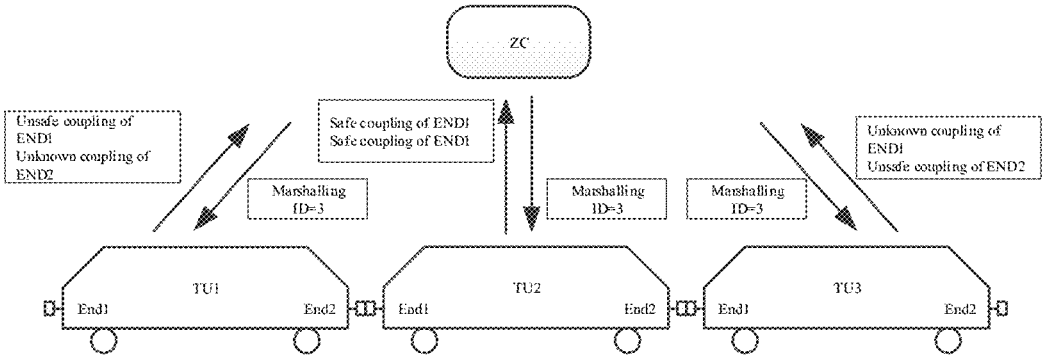
FIG. 9 is a schematic diagram of a train formation ID=3 in a specific embodiment.

(1) When operating with a single formation of TU1, if the ZC transmits information that two ends are in not safe coupling state, ZC replies TU1 with the formation ID=1 according to the calculation principle in the above technical solution, and CC of TU1 operates in a single marshalled train configuration after receiving it, as shown in FIG. 7;

(2) When operating with two formation coupling of TU1+TU2, if the CCs of TU1 and TU2 respectively send a state that one end is safely coupled and a state that the other end is unsafely coupled to the ZC, the ZC replies TU1 and TU2 with the formation ID=2 according to the calculation principle in the above technical solution, and CCs of TU1 and TU2 operates in a two formation coupled train configuration after receiving it, as shown in FIG. 8; and (3) When operating with three formation coupling of TU1+TU2+TU3, the CCs of TU1 and TU2 and TU3 respectively send the following coupling states to the ZC:

TU1: END1 is not safely coupled, and the coupling of END2 is unknown;

TU2: END1 is safely coupled, and END2 is safely coupled;

TU3: the coupling of END1 is unknown, and END2 is not safely coupled;

According to the calculation principle of the above technical solution, the ZC continues to check the coupling states of the subsequent trains after receiving the unknown coupling state of END2 of TU1, and ends when the not safe coupling state of END2 of TU3 is detected. Three TU3s have been passed during the process by statistical, so the formation ID=3 is responded to TU1, TU2 and TU3. After received, the CCs of TU1, TU2, and TU3 operate in a three-marshalling coupled train configuration, as shown in FIG. 9.

In any state other than the above (such as a fault in the coupling state or a formation greater than 3 TUs), the ZC would calculate the train formation as 0 and reply to the CC, which operates in an unknown train formation configuration after received.

The above is an introduction of method embodiments, and the solution of the present invention is further explained by electronic device and storage medium embodiments.

The electronic device of the present invention comprises a central processing unit (CPU) that can perform various appropriate actions and processes according to computer program instructions stored in a read-only memory (ROM) or loaded from a storage unit into a random access memory (RAM). In the RAM, various programs and data required for operations of the device can also be stored. The CPU, ROM, and RAM are connected to each other via a bus. An input/output (I/O) interface is also connected to the bus.

A plurality of components in the device are connected to the I/O interface, wherein the plurality of components comprise: an input unit, such as a keyboard, a mouse, etc.; an output unit, such as various types of displays, a speaker, etc.: a storage unit, such as a disk, an optical disc, etc.; and a communication unit, such as a network card, a modem, a wireless communication transceiver, etc. The communication unit allows the device to exchange information/data with other devices through a computer network such as the Internet and/or various telecommunications networks.

The processing unit performs each method and process described above, such as the method of the present invention. For example, in some embodiments, the method of the present invention may be realized as a computer software program that is physically contained in a machine readable medium, such as a storage unit. In some embodiments, parts or all of the computer program may be loaded and/or installed on the device via the ROM and/or communication unit. When the computer program is loaded into the RAM and executed by the CPU, one or more steps of the method of the present invention described above can be performed. Alternatively, in other embodiments, the CPU may be configured to execute the method of the present invention by any other appropriate means (e.g., by means of a firmware).

The functions described above herein can be performed, at least in part, by one or more hardware logical components. For example, without limitation, demonstration types of hardware logic components that can be used include: a Field Programmable Gate Array (FPGA), an Application-Specific Integrated Circuits (ASIC), an Application-Specific Standard Product (ASSP), a System-On-Chip (SOC), a Complex Programmable Logic Device (CPLD), etc.

Program codes for implementing the method of the present invention may be written in any combination of one or more programming languages. These program codes may be provided to a processor or controller of a general-purpose computer, a special-purpose computer or another programmable data processing apparatus so that the program codes, when being executed by the processor or controller, implements the functions/operations specified in the flow chart and/or block diagram. The program codes can be executed entirely on a machine, partially on a machine, partially on a remote machine as a stand-alone software package, or completely on a remote machine or server.

In the context of the present invention, the machine readable medium may be a tangible medium that may contain or store a program for use by or in conjunction with an instruction executing system, apparatus or device. The machine readable medium may be a machine readable signal medium or a machine readable storage medium. The machine readable medium may include, but are not limited to, an electronic, magnetic, optical, electromagnetic, infrared, or semiconductor system, apparatus, or device, or any suitable combination of the above. More specific examples of the machine readable storage medium would include an electrical connection based on one or more wires, a portable computer disk, a hard disk, a random access memory (RAM), a read-only memory (ROM), an erasable programmable ROM (EPROM or flash memory), optical fibers, a convenient compact disk ROM (CD-ROM), an optical storage device, a magnetic storage device, or any suitable combination of the above.

The above are only specific embodiments of the present invention, but the protection scope of the present invention is not limited to this, and any technical person familiar with the technical field can easily think of various equivalent modifications or replacements within the technical scope disclosed by the present invention, and these modifications or replacements shall be covered by the protection scope of the present invention. Therefore, the protection scope of the present invention shall be subject to the protection scope of the claims.

What is claimed is:

1. A safety check method and device for coupling of multiple train units in rail transit, comprising: determining train formation information to obtain the length, weight and traction braking characteristics of the whole train, so as to automatically protect the running of the train on a route and realize automatic driving, wherein all the train formation combinations and formation ID numbers in the route are pre-defined; when the formation ID number is greater than 2, a trackside zone controller ZC calculates a train formation ID according to a train coupling state detected by each controller CC, and continuously transmits the calculated train formation ID to the controller CC; and the controller CC controls and safely protects the train according to the obtained train formation.

2. The safety check method and device for coupling of multiple train units in rail transit according to claim 1, wherein all the train formation combinations and formation ID numbers are specifically as follows:

a minimum marshalled train ID that a single route can run is 1;

a formation ID of a coupled train consisting of two minimum marshalled trains is 2;

a formation ID of a coupled train consisting of three minimum marshalled trains is 3;

. . . , a formation ID of a coupled train consisting of X minimum marshalled trains is x, wherein X is the number of minimum marshalled trains.

3. The safety check method and device for coupling of multiple train units in rail transit according to claim 1, wherein the train coupling state detected by the controller CC is specifically as follows:

(1) input information "coupler coupling" and "coupler uncoupling" of couplers at both ends of each train acquired by the controller CC of the train; and (2) the train coupling state of each end of the train transmitted by the controller CC to the trackside controller ZC.

4. The safety check method and device for coupling of multiple train units in rail transit according to claim 1, wherein the zone controller ZC determines whether each end of the train is safely coupled according to a coupler coupling state transmitted by each controller CC, which is specifically as follows:

safe coupling state: ACS=1, ANCS=0;

not safe coupling state: ACS=0, ANCS=1; and unknown coupling state: ACS=1, ANCS=1 or ACS=0, ANCS=0, wherein ACS indicates that the coupler is coupled, and ANCS indicates that the coupler is uncoupled.

5. The safety check method and device for coupling of multiple train units in rail transit according to claim 1, wherein the calculation of the train formation ID by the trackside zone controller ZC comprises:

if two coupling states of one end of the train and one end of an adjacent train are both "not safe coupling state", or if one end of the train is "not safe coupling state" and one end of the adjacent train is "unknown coupling state", the ZC determines that the end of the train is not safely coupled; and if two ends of the train are both not "safely coupled", the ZC determines that the train is a non-coupled train and transmits a train formation ID=1 to the controller CC.

6. The safety check method and device for coupling of multiple train units in rail transit according to claim 1, wherein the calculation of the train formation ID by the trackside zone controller ZC comprises:

if two coupling states of two adjacent train ends are both "unknown coupling state", or if one is "safe coupling state" and the other one is "not safe coupling state", the ZC transmits a train formation ID=0 to each CC.

7. The safety check method and device for coupling of multiple train units in rail transit according to claim 1, wherein the calculation of the train formation ID by the trackside zone controller ZC comprises:

if two coupling states of two adjacent train ends are both "safe coupling state", or if one is "safe coupling state" and the other one is "unknown coupling state", the ZC checks the safety coupling states of two adjacent train ends on the other side until the train end "not safe coupling state", calculates the train formation ID according to the number of the passed "minimum train marshalled trains", and send the train formation ID to the controller CC.

8. The safety check method and device for coupling of multiple train units in rail transit according to claim 7, wherein if the coupling state of the last checked train end during calculation is "unknown coupling", the train formation ID is determined to be 0.

9. The safety check method and device for coupling of multiple train units in rail transit according to claim 1, wherein the train formation ID is obtained by means of internal calculation and determination of a signal system.

10. The safety check method and device for coupling of multiple train units in rail transit according to claim 1, wherein the method is applicable to various standards of rail transit signal systems.

11. The safety check method and device for coupling of multiple train units in rail transit according to claim 1, wherein the method is applicable to a fixed block system, a quasi-mobile block system and a mobile block system.

12. The safety check method and device for coupling of multiple train units in rail transit according to claim 1, wherein the method is applicable to a CBTC system, a CTCS system, an ETCS system, a PTC system, an ITCS system, and a TACS system.

13. The safety check method and device for coupling of multiple train units in rail transit according to claim 1, wherein the method supports online coupling and uncoupling of more than 2 marshalled trains.

14. An electronic device, comprising a processor and a memory in which a computer program is stored, wherein the processor, when executing the program, implements the method according to claim 1.

15. A computer-readable storage medium in which a computer program is stored, wherein the program, when being executed by a processor, implements the method according to claim 1.

* * * * *